US006355871B1

(12) United States Patent
Yamauchi

(10) Patent No.: US 6,355,871 B1
(45) Date of Patent: Mar. 12, 2002

(54) AUTOMATIC MUSICAL PERFORMANCE DATA EDITING SYSTEM AND STORAGE MEDIUM STORING DATA EDITING PROGRAM

(75) Inventor: Akira Yamauchi, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/662,094

(22) Filed: Sep. 14, 2000

(30) Foreign Application Priority Data

Sep. 17, 1999 (JP) ..... 11-263484

(51) Int. Cl.[7] ..... G10H 1/26
(52) U.S. Cl. ..... 84/609; 84/645; 84/649
(58) Field of Search ..... 84/609–614, 634–638, 84/645, 649–652, 666–669

(56) References Cited

U.S. PATENT DOCUMENTS 5,728,962 A * 3/1998 Goede ..... 84/609
5,747,716 A * 5/1998 Matsumoto ..... 84/609
5,990,404 A * 11/1999 Miyano ..... 84/609
5,990,406 A * 11/1999 Nakamura et al. ..... 84/609

FOREIGN PATENT DOCUMENTS

JP 11-202860 7/1999

* cited by examiner

*Primary Examiner*—Stanley J. Witkowski
(74) *Attorney, Agent, or Firm*—Morrison & Foerster LLP

(57) ABSTRACT

A musical performance data editing system having an edition designating unit for designating an edition position and edition contents, an edition range determining unit for determining an edition range in accordance with edition designation, and an editing unit for editing information regarding the edition contents in the determined edition range in accordance with the edition contents.

22 Claims, 15 Drawing Sheets

AUTOMATIC MUSICAL PERFORMANCE DATA EDITING SYSTEM AND STORAGE MEDIUM STORING DATA EDITING PROGRAM

This application is based on Japanese Patent Application HEI 11-263484, filed on Sep. 17, 1999, the entire contents of which are incorporated herein by reference.

BACKGROUND OF THE INVENTION a) Field of the Invention

The present invention relates to a musical performance data editing system, and more particularly to a performance data editing system capable of changing performance data to desired values.

b) Description of the Related Art

FIG. 13 is a diagram showing the format of real performance data.

The real performance data corresponds to automatic performance data of one musical program and includes tracks 1 to n each including initial setting information. If real performance data is stored in the format of a standard MIDI file, the initial setting information and real performance data are expressed in the format of MIDI data. MIDI data includes data regarding a start and end of each musical tone such as a note on/off and setting data for setting performance expression for consecutive musical tones such as tone color and effects.

The initial setting information is often placed at the top of real performance data. The initial setting information is preset in order to play music, such as tone color, volume and effects at the start of automatic performance.

Each track is roughly grouped into the initial setting information and the real performance data following the initial setting information. The real performance data includes parameters other than the initial setting information, for example, data after a first note-on event in the music.

The real performance data contains the note on/off as well as parameters (volume change and the like) effective only in a specific section.

For automatic performance, the initial setting data is first read to initially set tone color and the like. Then, the real performance data is read to perform the automatic performance including sound production and sound muting. The real performance data is terminated at end data.

A user sometimes desires to change real performance data according to the user preference. In such a case, the user changes a parameter (e.g., volume) at a designated position of real performance data by using a sequencer or a personal computer.

As a method of displaying MIDI data to edit it, three methods are well known including "musical score display", "numerical value display" and "piano roll display".

With the musical score display, musical scores of MIDI data are displayed. In editing the MIDI data, notes and symbols are placed or moved on, or deleted from, a staff notation on a display screen by using, for example, a mouse.

Musical score data is used for displaying real performance data. As the musical score data, data for displaying tune, rhythm and the like on a staff notation on a display screen, data for identifying corresponding real performance data, and the like are stored. After these data, position data is stored in correspondence with each timing data of the real performance data, and data for displaying a tone and symbol corresponding to an event at each timing.

In this specification, performance data is intended to mean automatic performance data including both real performance data and musical score data. If there is no musical score data corresponding to the real performance data, the performance data is intended to mean only the real performance data.

With the numerical value display, values of MIDI data are all represented by numerical values in a table format. In editing the MIDI data, a numerical value at an edition position is changed or deleted or a numerical value is entered at an edition position.

With the piano roll display, a length of each tone and its sound producing timing are represented by using a bar graph.

If a user changes a volume parameter (EXP) by designating one position in performance data, the volume of the note only at the designated position is changed and the values of parameters after the designated position are not changed.

EXP indicates MIDI expression data. The volume is determined in a range from 0 to 127. As this parameter is inserted, the following performance is made at the volume corresponding to the parameter value expressed by a numerical value in parentheses (refer to performance data shown in FIG. 13).

This method is effective for giving an accent to the note at the designated position. However, if this effect is different from a user intention, such as gradually changing the volume of notes, a discontinuity occurs between the edited data and following data, destroying rising and falling of notes or intonation.

In other cases, the values of all parameters after the edition position are changed to have the same value as the changed parameter. In such cases, although a discontinuity will not occur, rising and falling of notes is completely deleted.

In order to eliminate such disadvantages as unnatural performance after the edition position and edit real performance data, with the parameter intonation before edition being retained, it is necessary to manually change or insert each parameter after the edition position sequentially one after another.

SUMMARY OF THE INVENTION

It is an object of the present invention to provide a performance data editing system capable of automatically editing performance data in a manner desired by a user.

It is another object of the present invention to provide a performance data editing system capable of editing performance data in a manner desired by a user with simple operation.

According to one aspect of the present invention, there is provided a musical performance data editing system, comprising: edition designating means for designating an edition position and edition contents, edition range determining means for determining an edition range in accordance with edition designation; and editing means for editing information regarding the edition contents in the determined edition range in accordance with the edition contents.

According to another aspect of the present invention, there is provided a musical performance data editing system, comprising: edition designating means for designating an edition position and edition contents for data to be edited; first detecting means for detecting a parameter coincident with a predetermined condition from data at positions after the edition position; edition range determining means for determining an edition range in accordance with a detection result by the first detecting means; first editing means for changing a parameter at the edition position in accordance with the edition contents; second detecting means for detecting a parameter relevant to the edition contents in the edition range; and second editing means for editing the parameter detected by the second detecting means in the edition range.

According to this invention, performance data can be edited automatically in accordance with user intention. Performance data can also be edited in accordance with user intention with simple operations.

DETAILED DESCRIPTION OF THE PREFERRED EMBODIMENTS

Figure 1:
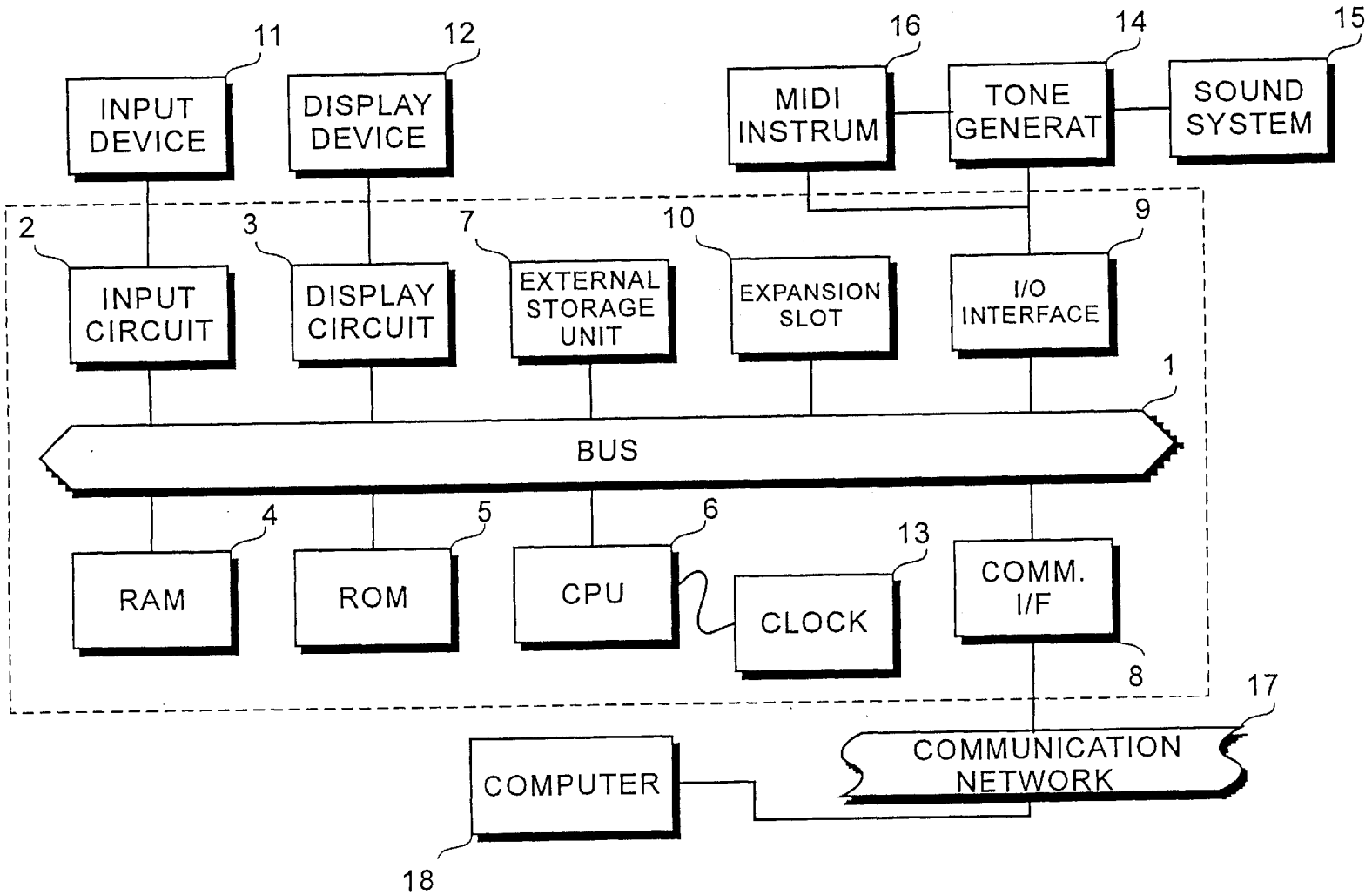
FIG. 1 is a block diagram showing a specific hardware structure of a general computer or personal computer.

FIG. 1 is a block diagram showing the fundamental structure of hardware of an electronic musical instrument or general computer including a performance data editing system according to an embodiment of the invention.

Connected to a bus 1 are an input circuit 2, a display circuit 3, a RAM 4, a ROM 5, a CPU 6, an external storage unit 7, a communication interface 8, an I/O interface 9, and an expansion slot 10.

By using an input device 11 connected to the input circuit 2, a user can edit performance data or enter other commands. The input device 11 may be of any type that can generate a signal corresponding to an user input, such as a mouse, a keyboard, a musical instrument keyboard, and a switch. A plurality of input devices may be connected.

The display circuit 3 is connected to a display unit 12 on which performance data before or after edition and the like can be displayed. A user can edit performance data by referring to performance data before edition displayed on the display unit 12.

Figure 2:
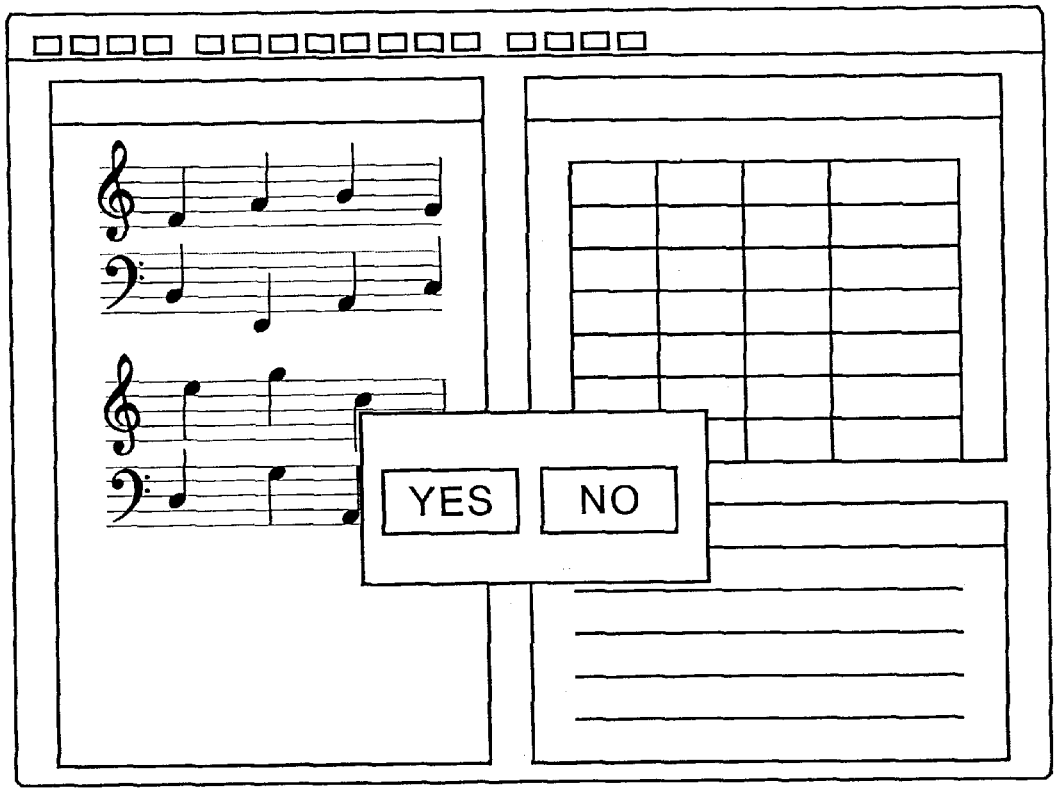
FIG. 2 is a diagram showing a window displayed on a display screen.

As shown in FIG. 2, musical score data and real performance data may be displayed side by side on the display unit 12 or either score data or real performance data may be displayed singularly. An image of original data before edition and an image of data during and after edition may be displayed in a juxtaposed form. An image herein used is intended to mean a musical score display of musical score data, a real performance data display of real performance data (such as a numerical value display and a piano roll display), or the like. If necessary, a plurality of windows may be displayed on the display unit 12.

The external storage unit 7 includes an interface via which it is connected to the bus 1. The external storage 7 may be a floppy disk drive (FFD), a hard disk drive (HDD), a magneto optical (MO) disk drive, a compact disk—read only memory (CD-ROM) drive or the like.

RAM 4 has a working area for CPU 6 storing MIDI real performance data and the like. ROM 5 stores therein various parameters and control programs, performance data editing programs of the embodiment, and the like. CPU 6 executes various calculations and controls in accordance with control programs and the like stored in ROM 5.

A clock 13 is connected to CPU 6 to supply it with a basic clock signal, an interrupt timing signal and the like.

Performance data before edition is stored in the external storage unit 7, RAM 4 or ROM 5. Performance data after edition is stored in a writable external storage unit 7 or ROM 4. Performance data before and after edition can be transferred to and from an external via the I/O interface 9 or communication interface 8.

The I/O interface 9 is used for connection to other electronic musical instruments, electronic acoustic apparatuses, computers and the like and may be a MIDI interface, a universal serial bus (USB) interface, IEEE 1394 or the like.

A tone generator 14 generates a musical tone signal corresponding to a supplied MIDI signal or the like and supplies it to a sound system 15. The sound system 15 includes a D/A converter and a speaker to convert a supplied digital tone signal into an analog signal and produce sound.

The tone generator 14 may be of any type such as a waveform memory type, an FM type, a physical model type, a high harmonic synthesis type, a formant type, and an analog synthesizer type of VCO+VCF+VCA.

The tone generator 14 may be made of not only dedicated hardware but also DSP+micro programs or CPU+software programs. The tone generator 14 may be a sound card inserted into the expansion slot 10.

A plurality of sound production channels may be formed by time divisionally using one tone generator circuit, or by using one tone generator per one sound production channel.

A MIDI instrument 16 is an acoustic apparatus, an musical instrument or the like connected to the tone generator 14 or I/O interface 9.

The control program, real performance data or the like may be stored in a hard disk of the external storage unit 7. By reading the control program or the like from the hard disk to RAM 4, CPU 6 can operate in a similar manner to the case that the control program or the like is stored in ROM 5. In this case, addition, version-up and the like of the control program or the like become easy.

The control program, performance data or the like may be stored in a CD-ROM. The control program, performance data or the like can be copied from CD-ROM to a hard disk. In this case, new installation, version-up and the like of the control program or the like become easy.

The communication interface 8 is used for connection to a communication network 17 such as a local area network (LAN), the Internet, and a telephone line. A control program, performance data or the like can be downloaded from a computer 18 connected via the communication network 17 into the external storage unit 7 such as HDD, RAM 4, or other storage devices. A performance data editing system at a client transmits a command to the computer 18 via the communication interface 8 and communication network 17, the command requesting to download a control program, performance data and the like. Upon reception of this command, the computer 17 transmits the requested control program, performance data and the like to the performance data editing system via the communication network 17 and communication interface 8, the requested control program, performance data or the like being stored in the external storage unit 7, RAM 4 or other storage devices to complete the download process.

The processes to be executed by CPU 6 will be described.

In this specification, "global editing data" is expression symbol data which influences the whole performance from the position an expression symbol is inserted to the position an expression symbol of the same kind is next inserted. Such expression symbols include a volume symbol such as forte (f) and mezzo forte (mf), a tempo symbol, and the like. This global editing data is therefore the expression symbol data indicating not a temporary change but a continuous change until the next instruction.

Also in this specification, "local editing data" is used in contrast with the "global editing data". This local editing data is expression symbol data which influences only the performance near the position an expression symbol is inserted. Such expression symbols include a volume symbol such as crescendo (cres.) and decrescendo (decres.). This local editing data is therefore the expression symbol data indicating a temporary change in the volume, tempo and the like.

Which expression symbol is the global editing data or local editing data can be automatically discriminated by referring to a global and local editing data table prepared in advance.

Figure 3:
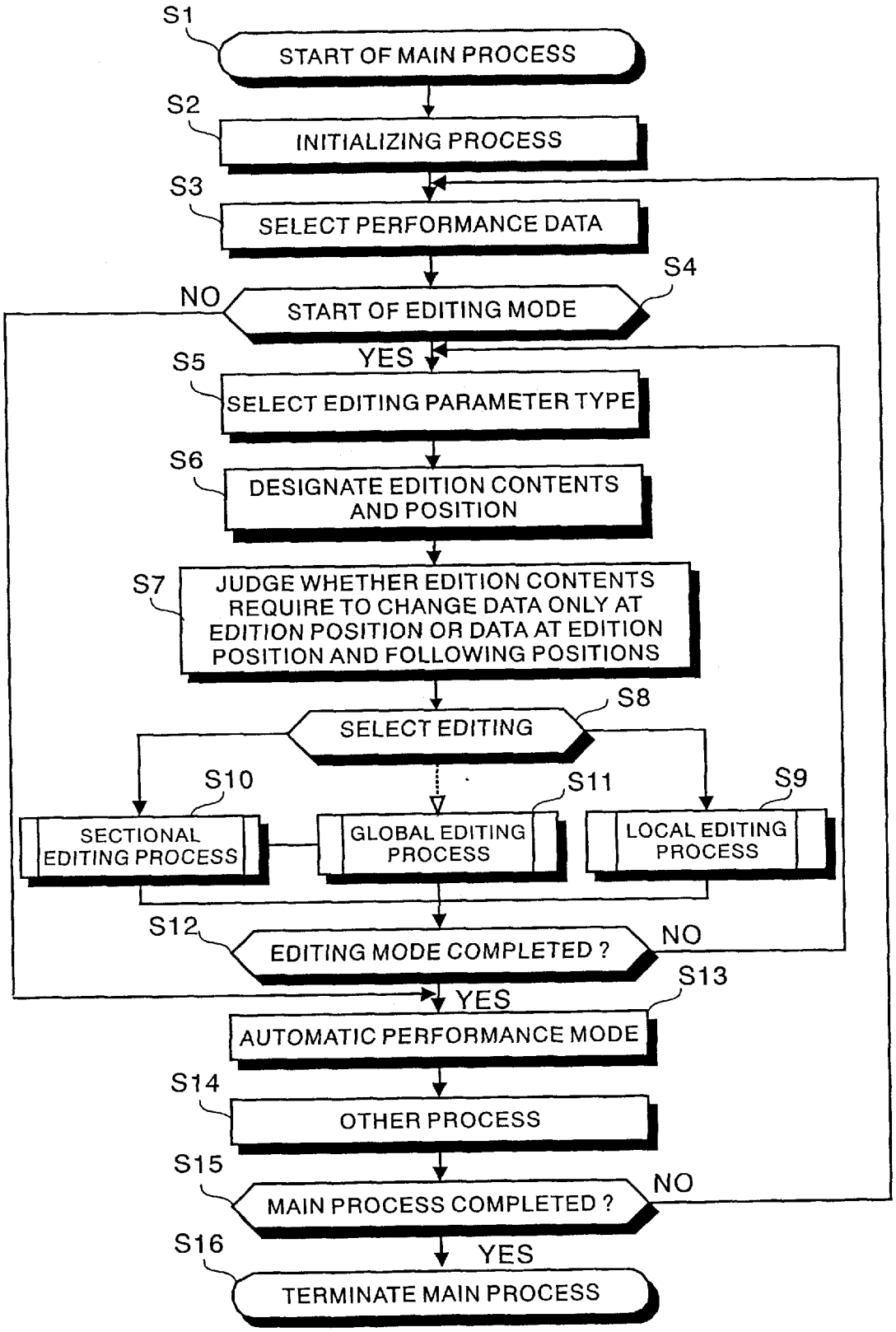
FIG. 3 is a flow chart illustrating a main process to be executed by a CPU.

FIG. 3 is a flow chart illustrating a main process to be executed by CPU.

At Step S1, the main process starts to follow next Step S2.

At Step S2, flags are initialized and an initial window is displayed on the display unit to follow next step S3.

At Step S3 performance data including real performance data to be edited or performed is selected from a plurality of performance data sets stored in ROM, RAM or external storage unit and read therefrom. The performance data may be downloaded via the communication network and communication interface. The flow then advances to Step S4.

At Step S4 it is judged from a user instruction whether the selected performance data is to be edited or not. If to be edited, an editing mode starts at Step S5 followed by an YES arrow.

If an automatic performance is to be performed immediately without editing the selected performance data, the flow advances to Step S13 followed by a NO arrow.

At Step S5 it is judged from a user instruction which type of a parameter is selected. The parameter includes a volume, a pitch-bend, a tempo, a pitch and the like. The flow then advances to Step S6.

At Step S6 edition contents and values are designated on the displayed window such as shown in FIG. 2 by using a mouse, keyboard or the like. In this manner, which position (edition position) of selected real performance data or musical score data is edited in what manner (edition contents) can be designated. If the selected performance data has a plurality of tracks (parts) and hence a plurality of real performance data sets and musical score data sets, one track to be edited is selected in accordance with a user instruction, and the edition position and contents are designated in the real performance data of the selected track. The flow then advances to next Step S7.

At Step S7 it is judged whether the edition contents designated at Step S6 correspond to an insertion of an expression symbol such as forte (f) and mezzo forte (mf) and require to change the data only at the edition position (e.g., change a velocity value) or the data at the edition position and following positions. The flow then advances to next Step S8.

In accordance with the judgment at Step S7, a data edition method is automatically selected at Step S8 either as a local editing process or a sectional editing process. If the edition contents require changing the data at the edition position and following positions, the flow advances to Step S10, whereas if the edition contents require changing the data only at the edition position, the flow advances to Step S9.

A user may select the editing mode. If a user desires to change the data only at the edition position although the edition contents require to change the data at the edition position and following positions, the local editing process at Step S9 is selected, whereas if the user desires to change the data at the edition position and following all positions, then a global editing process at Step S11 is selected.

Figure 4:
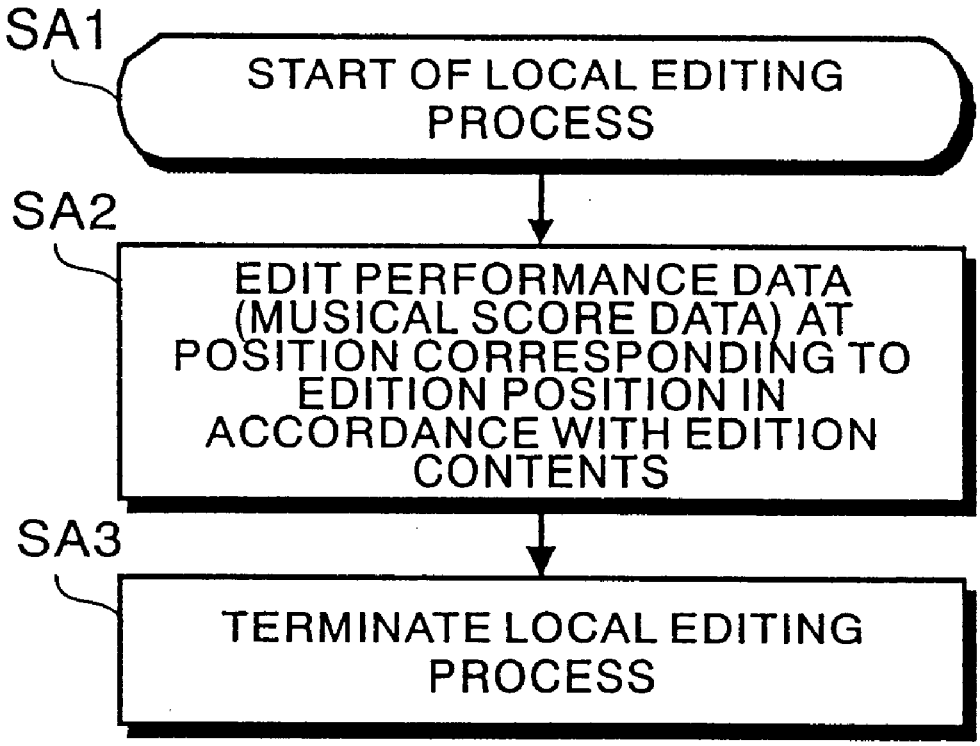
FIG. 4 is a flow chart illustrating a local editing process to be executed by CPU.

At Step S9 the local editing process illustrated in FIG. 4 is executed for both the real performance data and musical score data or for only the real performance data.

Referring to FIG. 4, at Step SA1 the local editing process starts, and at next Step SA2 the performance data at the position corresponding to the designated edition position is edited in accordance with the designated edition contents. The flow then advances to Step SA3 whereat the local editing process is terminated. Thereafter, the flow advances to Step S12 shown in FIG. 3.

Figure 5:
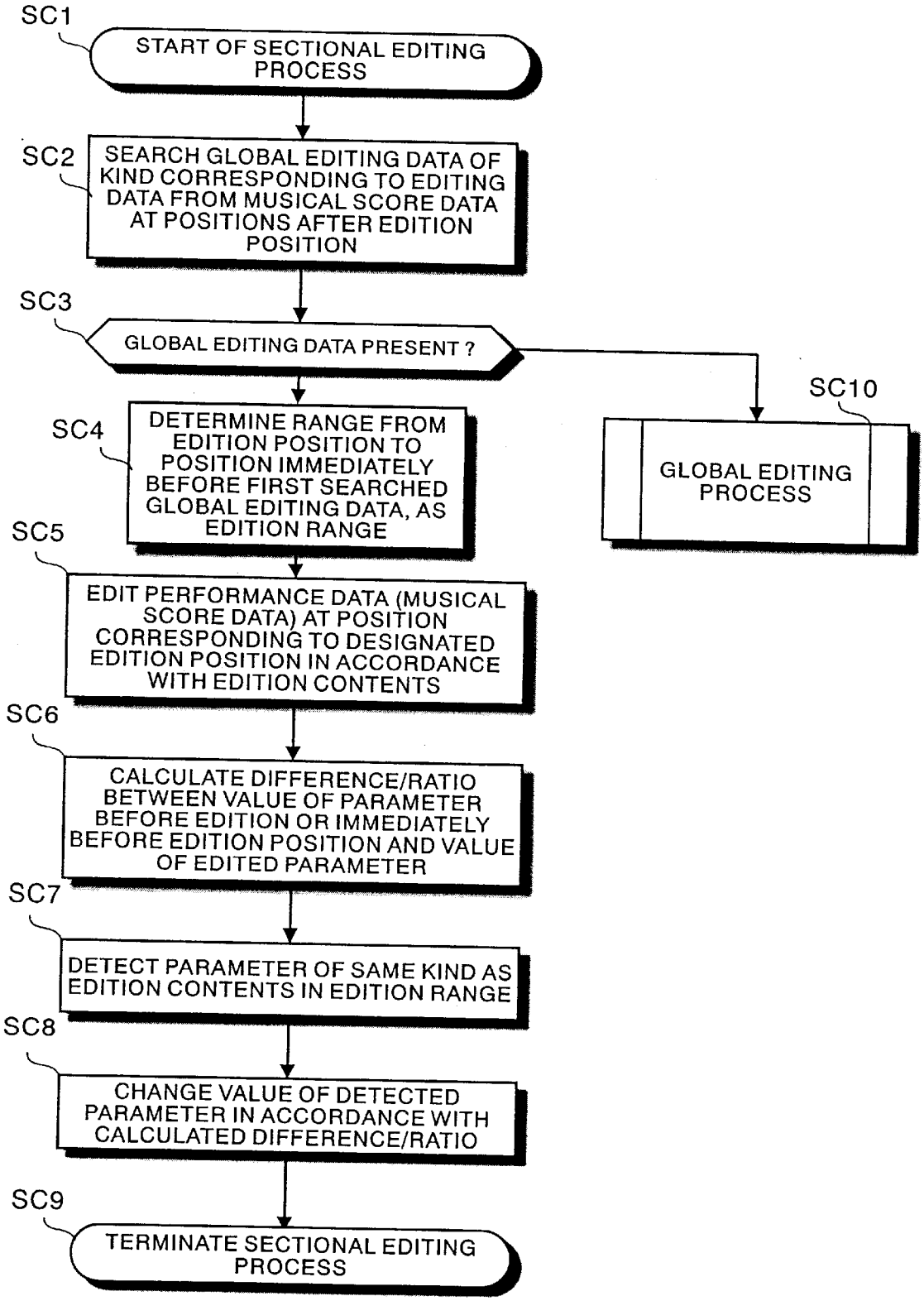
FIG. 5 is a flow chart illustrating a sectional editing process to be executed by CPU.

At Step S10 the sectional editing process illustrated in FIG. 5 is executed for both the real performance data and musical score data or for only the real performance data.

Figure 6:
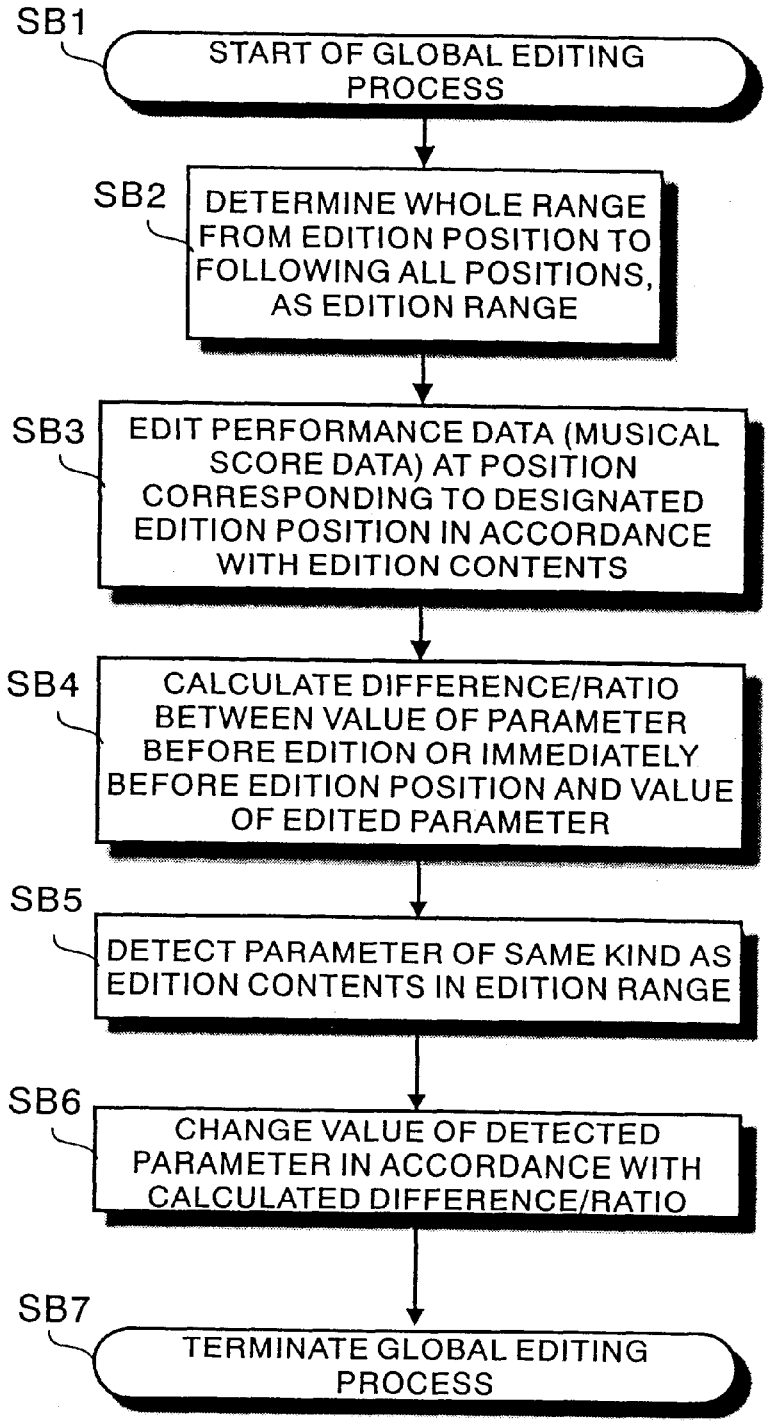
FIG. 6 is a flow chart illustrating a global editing process to be executed by CPU.

At Step S11 shown in FIG. 3, the global editing process to be described later with reference to FIG. 6 is executed for both the real performance data and musical score data or only for the real performance data. After the global editing process is completed, the flow advances to next Step S12.

At Step S12 it is judged from a user instruction whether the editing mode is completed or not. If completed, the editing mode is terminated to advance to Step S13 followed by a YES arrow, If the editing mode is not terminated but the editing process is further executed, the flow returns to Step S5 followed by a NO arrow.

At Step S13 a start or end of a general automatic performance of edited real performance data or selected real performance data is instructed by a user. Reproducing musical sounds of real performance data is executed by an interrupt process which is activated at a generation timing of an automatic performance clock (not shown). Thereafter, the flow advances to Step S14.

Depending upon a user choice, the automatic performance may not be executed at Step S13 but the flow may skip directly to next Step S14. Until a user instructs an end of the automatic performance, this automatic performance may be repeated.

At Step S14 a process of transferring data to and from an external, a process of changing settings of automatic performance such as effects and tone color, and other processes are executed. Thereafter, the flow advances to next Step S15.

At Step S15 it is judged from a user instruction whether the main process is completed. If completed, the flow advances to Step S16 followed by a YES arrow, whereas if not completed, the flow returns to Step S3 followed by a NO arrow.

At Step S16 the main process is terminated.

FIG. 5 is a flow chart illustrating the sectional editing process to be executed by CPU.

The sectional editing process starts at Step SC1 to follow next Step SC2.

At Step SC2 editing data of the same kind as the designated edition data (edition contents) is searched from the musical score data at any position after the designated edition position. Thereafter, the flow advances to next Step SC3.

Searching the global editing data is executed in order to determine the end position of an edition section. The reason why the global editing data is used at the end position of the edition section is as follows. In a usual musical performance, rising and falling of tones or intonation is effected for a new expression symbol corresponding to the global editing data, starting from the position of the new expression symbol, after the intonation for the old expression symbol is stopped. In order to reliably realize such a musical performance, the global editing data is searched.

If the musical score data is not stored, a change position of a specific parameter value in the real performance data may be searched, (e.g., a position where there is a difference between two old and new parameters larger than a predetermined value, may be searched) to use it as the position of the global editing data.

The position where the parameter value changes abruptly indicates an abrupt change in intonation, or can be considered as the position where a new expression symbol (corresponding to the global editing data in this embodiment) was added or is to be added. It is therefore proper to judge that the position where the parameter value changes abruptly corresponds to the global editing data position.

Instead of storing musical score data, data representative of the global editing data may be inserted into real performance data. In this case, even if musical score data corresponding to real performance data is not stored, the edition section or range can be determined easily and reliably.

At Step SC3 it is judged from the search result whether there is any global editing data. If there is any global editing data, the flow advances to next Step SC4, whereas if not, the sectional editing process is terminated to transit to the global editing process illustrated in FIG. 6.

At Step SC4 a range from the designated edition position to the position just before the first searched global editing data is determined as the edition range or section. Thereafter, the flow advances to Step SC5.

It is preferable to add a process of judging whether the expression symbol of the edition contents corresponds to the global editing data, and to determine the edition section from the judgment contents. If the edition contents correspond to the global editing data, the edition section is determined by the above-described method. If the edition contents correspond to the local editing data, a predetermined section length (e.g., two measures) is determined as the edition section. Ajudgment whether the expression symbol corresponds to the global editing data or local editing data can be made by using a table. This table is prepared in ROM and stores a correspondence between each expression symbol and a local editing symbol or a global editing symbol.

If it is judged that the expression symbol of the edition contents corresponds to the local editing data, the edition section may also be determined in accordance with a change amount of an edition value calculated at Step SC6 to be later described. For example, if the change amount is large, the predetermined section length may be elongated, whereas if the change amount is small, the predetermined section length may be shortened.

A predetermined edition section length for each expression symbol may be stored in a table to set a different section length for each expression symbol in accordance with the kinds and contents of the expression symbol.

The edition range or section may be designated by a user, without automatically determining the edition range as described above.

At Step SC5 the performance data at the position corresponding to the edition position designated at Step S6 shown in FIG. 3 is edited in accordance with the designated edition contents. Thereafter, the flow advances to Step SC6.

At Step SC6, a difference is calculated between the parameter value before edition or immediately before the edition position and the parameter value after edition. For example, if an already existing parameter value is to be changed, a difference is calculated between the parameter value before change and the parameter value after change.

If a parameter is to be newly inserted, a parameter of the same kind immediately before the newly inserted parameter is detected, and a difference between the detected parameter value and the newly inserted parameter value is calculated. If a parameter is to be deleted, a difference is calculated between the value of the parameter to be deleted and the value of the parameter immediately before and after the parameter to be deleted. Thereafter, the flow advances to next Step SC7.

A change in the parameter value to be calculated is not limited only to a difference, but a user may select either a difference or a ratio between parameter values as a change in the parameter value.

At Step SC7 all parameters of the same kind as the edition contents designated by the user are detected in the determined edition range. For example, if the edition contents correspond to the volume (EXP), all EXP parameters in the edition range are detected. Thereafter, the flow advances to Step SC8.

At Step SC8, the value of each detected parameter is changed through addition or multiplication by using the calculated difference or ratio. Thereafter, the flow advances to next Step SC9.

At Step SC9 the sectional editing process is terminated.

FIG. 6 is a flow chart illustrating the global editing process to be executed by CPU.

At Step SB1, the global editing process starts to follow next Step BS2.

At Step SB2, the whole range from the designated edition position to following all positions is determined as the edition range. Thereafter, the flow advances to next Step SB3.

At Step S83 the performance data at the position corresponding to the edition position designated at Step S6 shown in FIG. 6 is edited in accordance with the designated edition contents. Thereafter, the flow advances to next Step SB4.

At Step SB4 a difference is calculated between the parameter value before edition or immediately before the edition position and the parameter value after edition. For example, if an already existing parameter value is to be changed, a difference is calculated between the parameter value before change and the parameter value after change.

If a parameter is to be newly inserted, a parameter of the same kind immediately before the newly inserted parameter is detected, and a difference between the detected parameter value and the newly inserted parameter value is calculated. If a parameter is to be deleted, a difference is calculated between the value of the parameter to be deleted and the value of the parameter immediately before and after the parameter to be deleted. Thereafter, the flow advances to next Step SB5.

A change in the parameter value to be calculated is not limited only to a difference, but a ratio such as an increasing or decreasing factor of parameter values may be used. A user may select either a difference or a ratio between parameter values as a change in the parameter value.

At Step SB5 all parameters of the same kind as the edition contents are detected in the determined edition range (in this case, the whole range from the edition position to following all positions). For example, if the edition contents correspond to the volume (EXP), all EXP parameters in the edition range are detected. Thereafter, the flow advances to Step SB6.

At Step SB6, the value of each detected parameter is changed through addition or multiplication by using the calculated difference or ratio. Thereafter, the flow advances to next Step SB7.

At Step SB7 the global editing process is terminated.

Edition Examples 1 to 3 for real performance data will be described with reference to FIGS. 7A to 12C. Data given in the following Examples is constituted of real performance data of the MIDI format used for producing real music sounds and musical score data used for displaying musical scores corresponding to the real performance. For the convenience of explanation, it is assumed that only one part (track) is recorded as the performance data. However, a plurality of parts are recorded for some performance data.

In this embodiment, initial setting information is recorded at the start of the real performance data. The initial setting information includes an initial volume setting value, an initial tempo value, a track tone color, effects and the like. After the initial setting information, timings for MIDI events and corresponding events are recorded. EXP is MIDI expression data.

At the start of the musical score data, initial setting information is recorded. The initial setting information includes information for displaying tune, rhythm and the like on a staff notation on a display screen, information for identifying the corresponding real performance data, and other information. After this information, position data is recorded in correspondence with each timing data of the real performance data, and after this, information for displaying a musical score and an expression symbol corresponding to an event at each timing are recorded.

In the following Examples, it is assumed that the musical score data mezzo forte (mf), forte (e and mezzo piano (mp) correspond to EXP (50), EXP (70) and EXP (40), respectively. For example, if mf is inserted into the musical score data, it means that EXP (50) is inserted into the real performance data at the corresponding position.

Conversely if EXP (50) is inserted into the real performance data, mf may be inserted into the musical score data at the corresponding position in order to reflect the insertion of EXP (50) or may not be inserted in order not to reflect the insertion of EXP (50). In the following Examples, it is assumed that direct edition of the real performance data is not accompanied with a change in the musical score data.

Although a volume (EXP) is used as an example of the edition parameter, other parameters whose values change with time may also be used, such as a tempo value and a pitch-bend value.

EXAMPLE 1

Example 1 will be described with reference to FIGS. 7A to 7D and FIGS. 8A and 8B. In this Example 1, the global editing data does not exist in the range after the position at which a user inserted new volume (EXP) data.

Figure 7A:
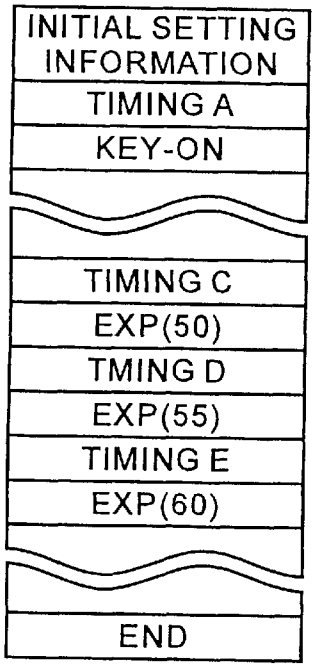
FIGS. 7A to 7D are diagrams showing performance data.

FIG. 7A is a diagram showing real performance data before edition. After the initial setting information, there is a key-on event at timing A when sound production starts. Thereafter, the volume is gradually increases, 50 at timing C, 55 at timing D and 60 at timing E. At the end of the real performance data, end data is recorded to indicate the end of the performance.

In this Example 1, the edition contents require to change the expression data after the designated position when the new expression data is inserted. Therefore, the sectional editing process shown in FIG. 5 is executed. Since the global editing data does not exist after the designated position, the global editing process shown in FIG. 6 is automatically executed.

In Example 1, a user refers to the real performance data (e.g., in the right side screen shown in FIG. 2) and edits the real performance data. Upon this edition of the real performance data, first the real performance data is changed.

Figure 7B:
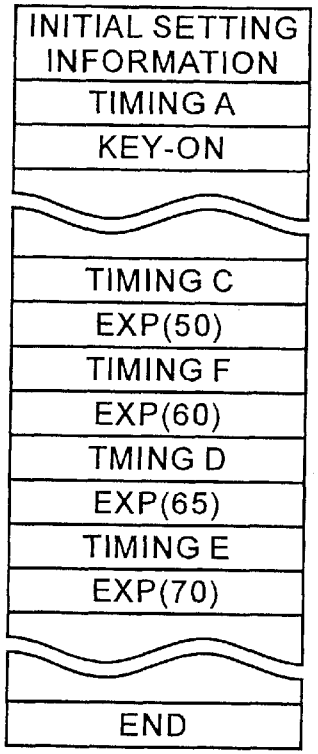

FIG. 7B is a diagram showing the real performance data after edition by the global editing process shown in FIG. 6. The user instructs to insert EXP (60) at timing F between timings C and D of the real performance data.

The whole range after the designated position is determined as the edition range and then a new parameter is inserted at timing F of the real performance data.

Next, a difference is calculated between the parameter value EXP (50) at timing C and the inserted parameter value EXP (60) immediately after the parameter EXP (50). In Example 1, the difference is "10". Parameters (EXP) of the same kind after timing F are detected. In Example 1, parameters (EXP) at timings D and E are detected.

The calculated difference "10" is added to the detected parameters. With these operations, the data shown in FIG. 7B is obtained.

Figure 8A:
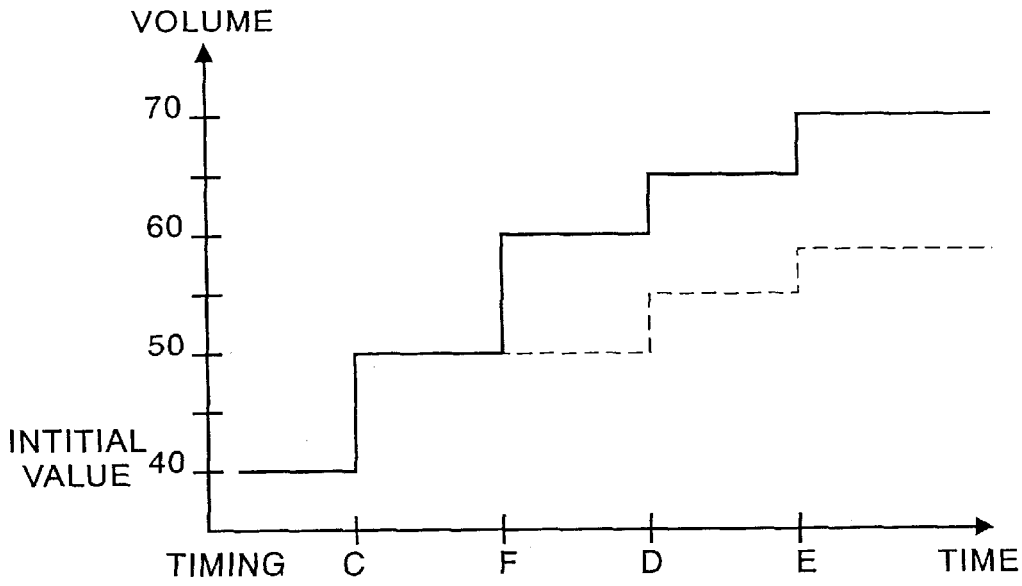
FIGS. 8A and 8B are timing charts illustrating volume changes.

FIG. 8A is a graph showing a change in the volume according to the data shown in FIGS. 7A and 7B. In FIG. 8A, a broken line represents the data before edition (FIG. 7A) and a solid line represents the data after edition (FIG. 78).

It can be understood from these two lines that the volume is gradually increased after the edition, similar to the volume before the edition. Rising and falling of original tones, i.e., a gradual increase of the volume, is maintained.

Next, the operation to be executed when a user manually selects the local editing process will be described.

Figure 7C:
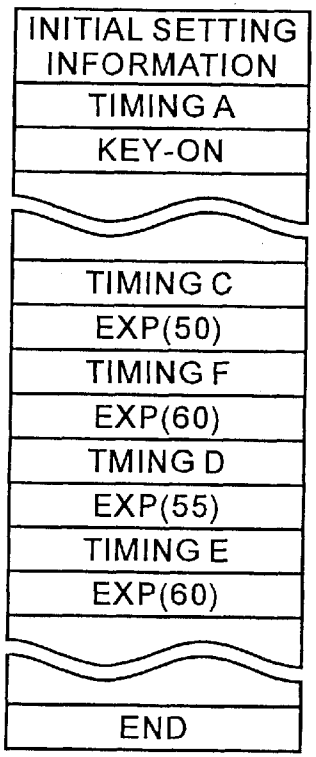

FIG. 7C is a diagram showing real performance data obtained by editing the data shown in FIG. 7A by the local editing process shown in FIG. 4. In Example 1, EXP (60) only is inserted at timing F between timings C and D. The other parameter values are not changed.

Figure 8B:
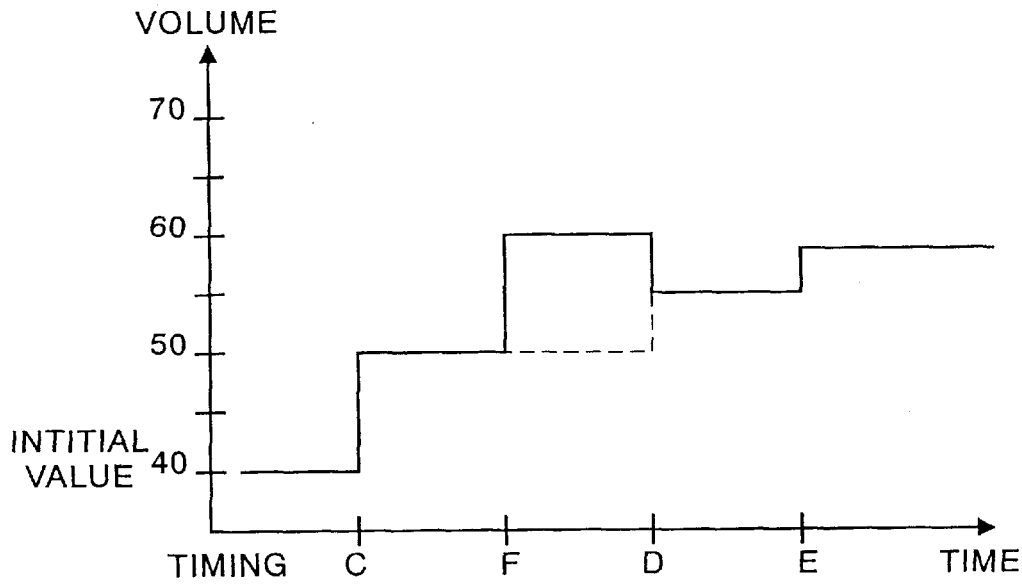

FIG. 8B is a graph showing a change in the volume corresponding to the data shown in FIGS. 7A and 7C. In FIG. 8B, a broken line represents the data before edition (FIG. 7A) and a solid line represents the data after edition (FIG. 7C).

As seen from comparison of these two lines, although the volume of the data before the edition increases gradually, the volume of the data after the edition lowers at timing D and the gradual volume rising intonation is lost.

The local editing process can give an accent to the note at the edition position, whereas the global or sectional editing process retains the original intonation of notes.

Figure 7D:
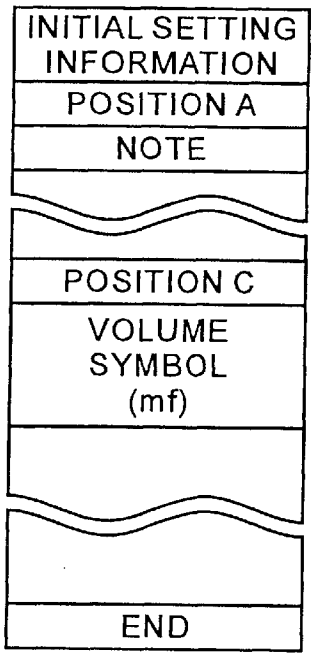

FIG. 7D is a diagram showing musical score data before and after edition. In Example 1, a user directly changes the performance data and there is no change in the musical score data.

The data shown in FIG. 7B at timing E is changed to EXP (70) by the global editing process. Forte (f) may be inserted into the musical score data at timing E in order to reflect such data change.

EXAMPLE 2

Example 2 will be described with reference to FIGS. 9A to 9G and FIGS. 10A to 10C. In this Example 2, the global editing data exists after the position at which a user inserted new volume (EXP) data. In Example 2, a user adds a new parameter to musical score data.

In Example 2, a user refers to the musical score data (e.g., in the left side screen shown in FIG. 2) and edits the musical score data. Upon this edition of the musical score data, first the musical score data is changed and thereafter the real performance data is changed at corresponding positions.

Figure 9A:
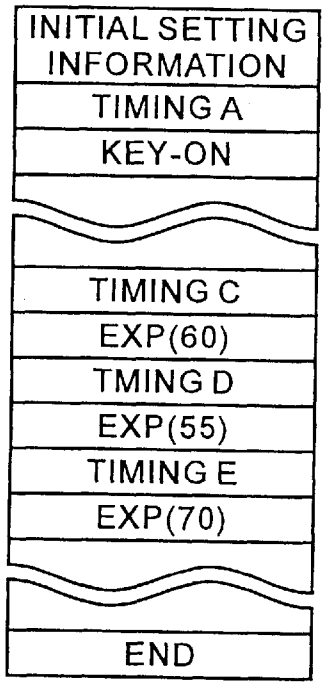
FIGS. 9A to 9G are diagrams showing performance data.

FIG. 9A is a diagram showing real performance data before edition. After the initial setting information, there is a key-on event at timing A when sound production starts. Thereafter, the volume is changed to EXP (60) at timing C, EXP (55) at timing D and EXP (70) at timing D. As shown by a broken line in FIG. 10A, after the volume is once lowered to "55", it is raised to "70". At the end of the real performance data, end data is recorded to indicate the end of the performance.

Figure 9B:
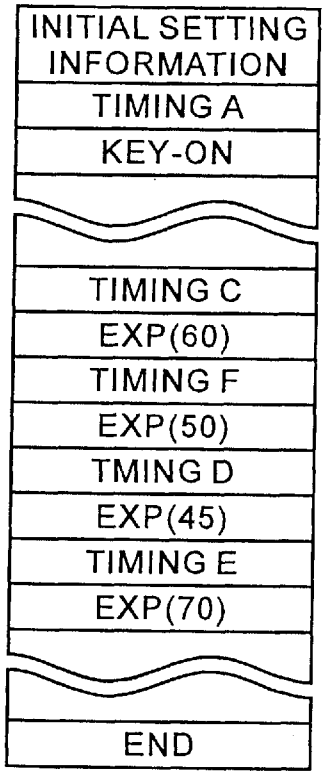
Figure 9C:
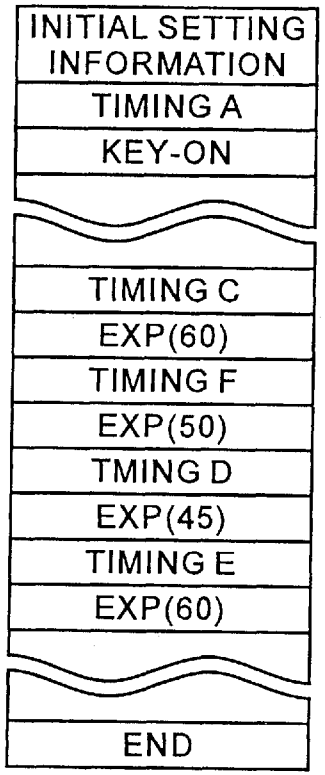
Figure 9D:
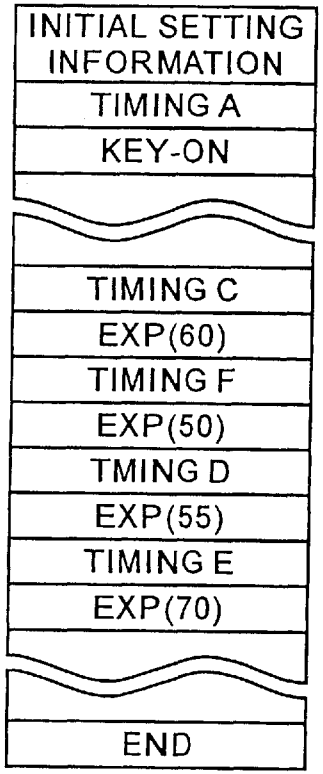
Figure 9E:
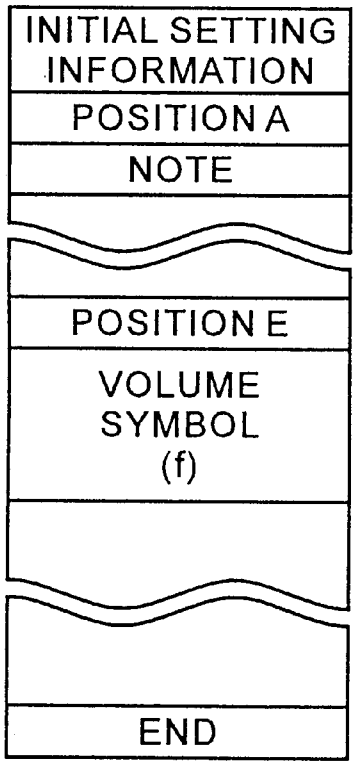

FIG. 9E is a diagram showing the musical score data before edition. After the initial setting information, a note is recorded at position A corresponding to timing A of the real performance data. After this position, a volume symbol forte (f) is recorded at position E corresponding to timing E of EXP (70).

A user instructs to enter a volume symbol mezzo forte (mf) into the musical score data at position F corresponding to a timing between timings C and D of the real performance data shown in FIG. 9A.

In this Example 2, the edition contents (insertion of the volume symbol mezzo forte (mf)) indicate an insertion of the expression data and require to change the expression data after the designated position when the new expression data is inserted. Therefore, the sectional editing process shown in FIG. 5 is automatically executed.

Figure 9F:
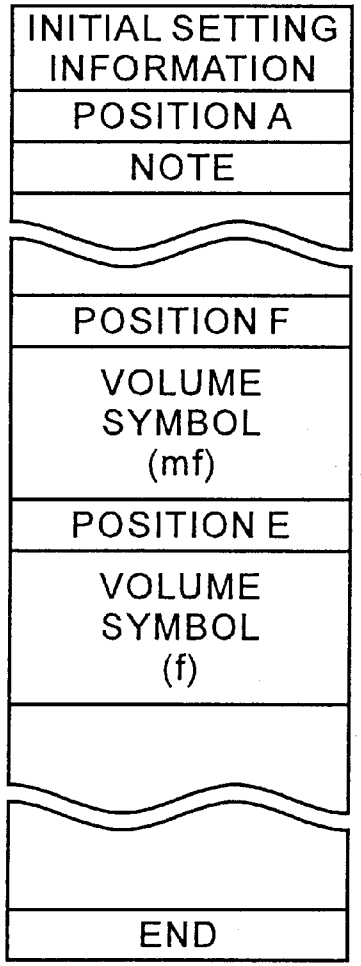

The operation of editing the data shown in FIG. 9A by the sectional editing process shown in FIG. 5 will be described with reference to FIGS. 9B and 9F.

First, volume symbols after the designated position are searched. Since forte (f) is stored at position E, the edition range is determined as a range down to the position immediately before position E. For the real performance data, a range down to the position immediately before timing D is determined as the edition range.

Next, mezzo forte (mf) is inserted into the musical score data at position F, and EXP (50) is inserted into the real performance data at corresponding timing F. The musical score data is therefore changed as shown in FIG. 9F.

Next, a difference is calculated between the parameter value EXP (60) at timing C and the inserted parameter value EXP (50) immediately after the parameter EXP (50). In Example 2, the difference is "−10". Parameters (EXP) of the same kind in the edition range are detected. In Example 2, a parameter (EXP) at timing D is detected.

The calculated difference "−10" is added to the detected parameter. With these operations, the parameter value at timing D is changed to EXP (45) as shown in FIG. 9B.

Figure 10A:
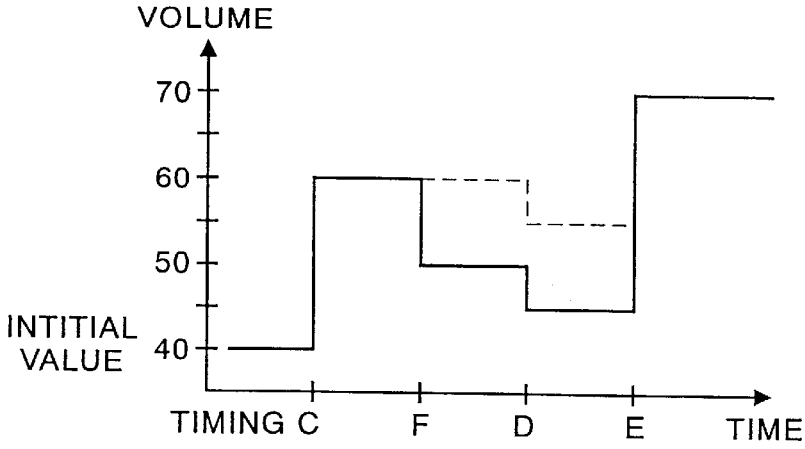
FIGS. 10A to 10C are timing charts illustrating volume changes.

FIG. 10A ia a graph showing a change in the volume according to the data shown in FIGS. 9A and 9B. In FIG. 10A, a broken line represents the data before edition (FIG. 9A) and a solid line represents the data after edition (FIG. 9B).

The data before the edition indicated by the broken line has the intonation that the volume lowers once and thereafter rises. The data after the edition indicated by the solid line retains the intonation although the volume change width becomes wide.

Next, the operation to be executed when a user manually selects the local or global editing process will be described.

FIG. 9D is a diagram showing real performance data obtained by editing the data shown in FIG. 9A by the local editing process shown in FIG. 4. The operation to be executed for the musical score data is similar to that of the above-described sectional editing process.

Only EXP (50) is inserted into the real performance data at timing F between timings C and D. The other parameter values are not changed.

Figure 10B:
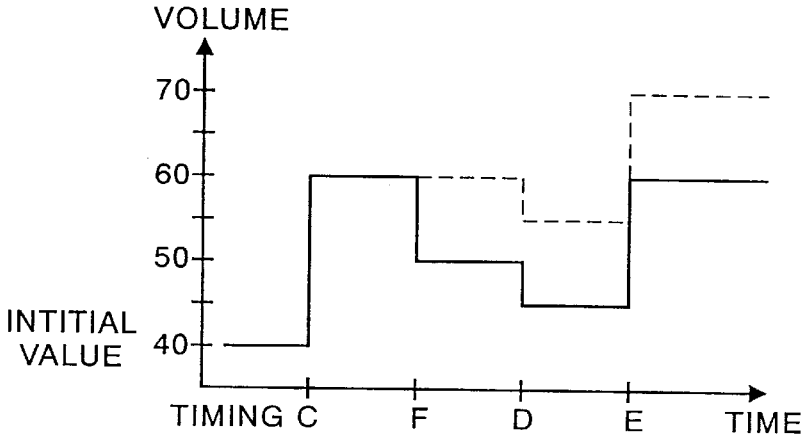
Figure 10C:
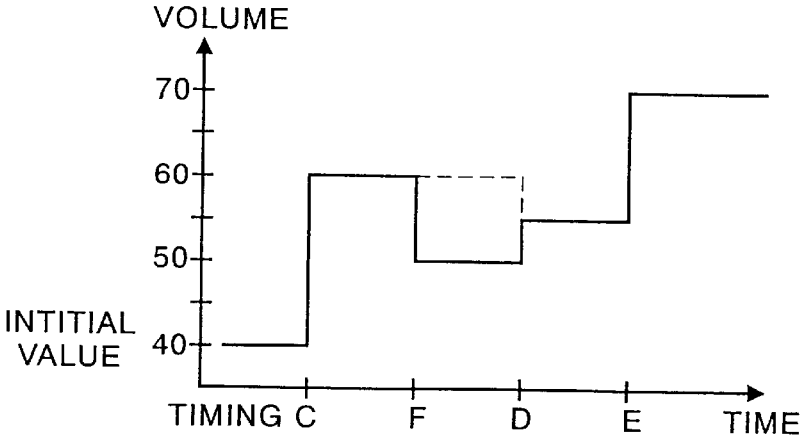

FIG. 10C is a graph showing a change in the volume corresponding to the data shown in FIGS. 9A and 9D. In FIG. 10C, a broken line represents the data before edition (FIG. 9A) and a solid line represents the data after edition (FIG. 9D).

The data before the edition indicated by the broken line has the intonation that the volume lowers once and thereafter rises. The data after the edition gradually lowers its volume after timing F. The intonation of the data before the edition is lost. If the intonation of tones is to be retained, the global or sectional editing process is selected.

FIG. 9C is a diagram showing real performance data obtained by editing the data shown in FIG. 9A by the global editing process shown in FIG. 6.

First, the whole range after the designated position is determined as the edition range, and mezzo forte (mf) is inserted into the musical score data at position F, and EXP (50) is inserted into the real performance data at corresponding timing F. The musical score data is therefore changed as shown in FIG. 9F.

Next, a difference is calculated between the parameter value EXP (60) at timing C and the inserted parameter value EXP (50) immediately after the parameter EXP (50). In Example 2, the difference is "−10". Parameters (EXP) of the same kind in the edition range are detected. In Example 2, parameters (EXP) at timings D and E are detected.

The calculated difference "−10" is added to the detected parameters. With these operations, the parameter value at timing D is changed to EXP (45) and the parameter value at timing E is changed to EXP (60), as shown in FIG. 9C.

FIG. 10B is a graph showing a change in the volume corresponding to the data shown in FIGS. 9A and 9C. In FIG. 10B, a broken line represents the data before edition (FIG. 9A) and a solid line represents the data after edition (FIG. 9C).

The data before the edition indicated by the broken line has the intonation that the volume lowers once and thereafter rises. The data after the edition indicated by the solid line also retains the original intonation. However, since the global editing data is changed, the parameter value at timing E corresponding to the position of the real performance data is changed to EXP (60) regardless of forte (f) inserted into the musical score data at position E.

Namely, although the intonation can be retained perfectly, the musical score data and real performance data contradict each other. In order to solve this problem, the musical score data is made to be automatically changed. Since the volume at position E is changed to a volume corresponding to mezzo forte (mf), the volume symbol at position E is changed from forte (f) to mezzo forte (mf).

Figure 9G:
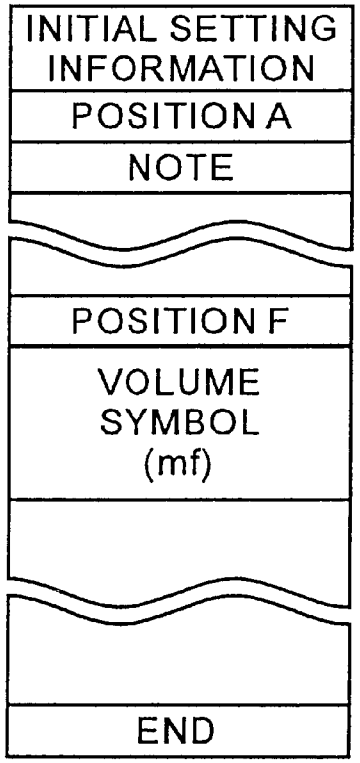

However, since the volume symbol mezzo forte (mf) is present at the position (position F) immediately before position E, the volume symbol at position E may be deleted in order to avoid double occurrences, as shown in FIG. 9G.

EXAMPLE 3

Example 3 will be described with reference to FIGS. 11A to 11G and FIGS. 12A to 12C. In this Example 3, the local or global editing data exists after the position at which a user inserted new volume (EXP) data. In Example 3, a user adds a new parameter to musical score data.

In Example 3, a user refers to the musical score data (e.g., in the left side screen shown in FIG. 2) and edits the musical score data. Upon this edition of the musical score data, first the musical score data is changed and thereafter the real performance data is changed at corresponding positions.

Figure 11A:
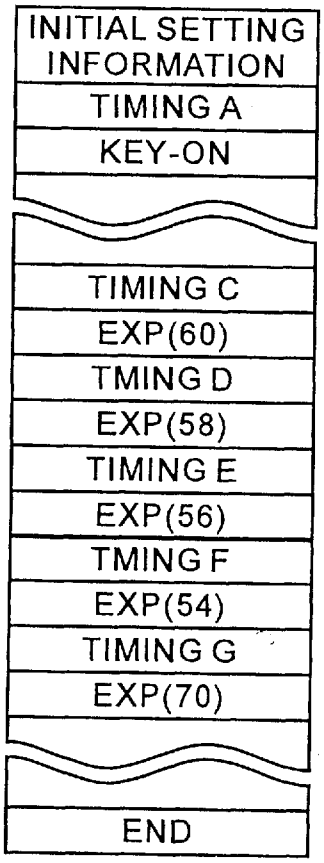
FIGS. 11A to 11G are diagrams showing performance data.

FIG. 11A is a diagram showing real performance data before edition. After the initial setting information, there is a key-on event at timing A when sound production starts. Thereafter, the volume is changed to EXP (60) at timing C, EXP (58) at timing D, EXP (56) at timing E, EXP (54) at timing F and EXP (70) at timing G. As shown by a broken line in FIG. 12A, after the volume is gradually lowered to EXP (54), it is increased to EXP (70). At the end of the real performance data, end data is recorded to indicate the end of the performance.

Figure 11B:
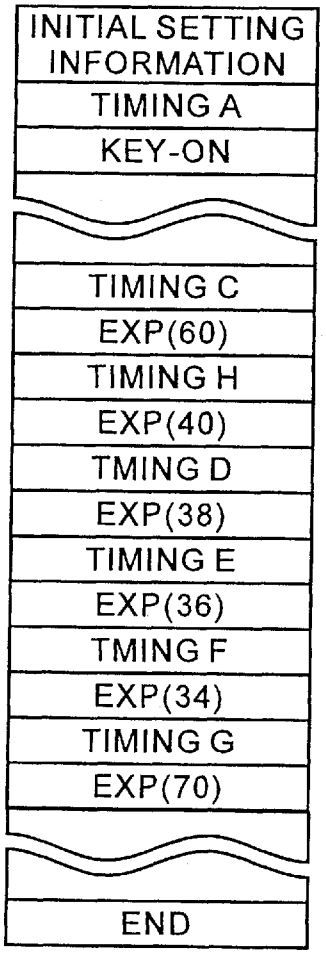
Figure 11C:
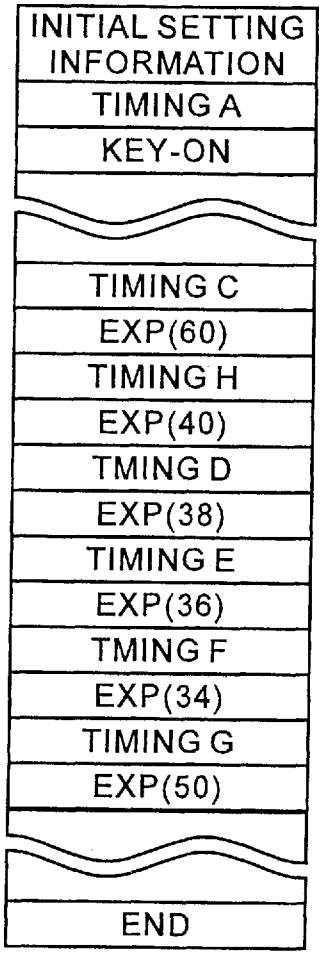
Figure 11D:
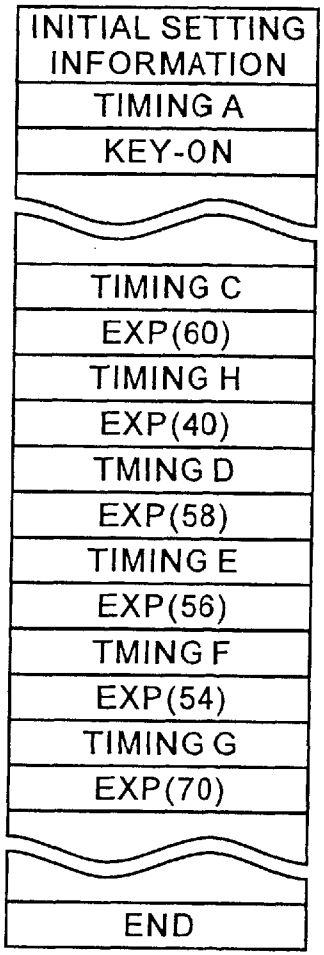
Figure 11E:
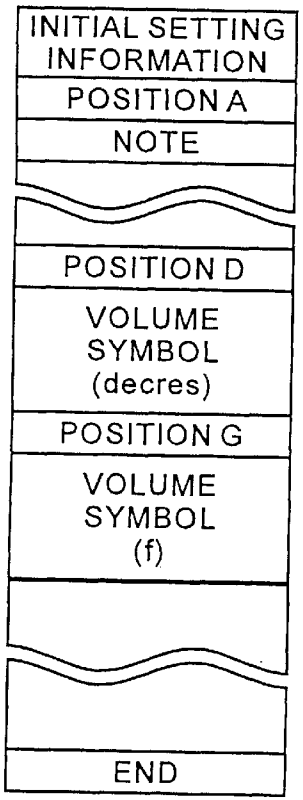

FIG. 11E is a diagram showing the musical score data before edition. After the initial setting information, a note is recorded at position A corresponding to timing A of the real performance data. After this position, a volume symbol decrescendo (decres.) is recorded at position D. This corresponds to a reduction in the volume between timings D and F of the real performance data. The expression symbol decrescendo (decres.) is local editing data. A volume symbol forte (f) is recorded at position G as the global editing data.

A user instructs to enter a volume symbol mezzo piano (mp) into the musical score data at position H corresponding to a timing between timings C and D of the real performance data shown in FIG. 11A.

In this Example 3, the edition contents (insertion of the volume symbol mezzo piano (mp)) indicate an insertion of the expression data and require to change the expression data after the designated position when the new expression data is inserted. Therefore, the sectional editing process shown in FIG. 5 is automatically executed.

Figure 11F:
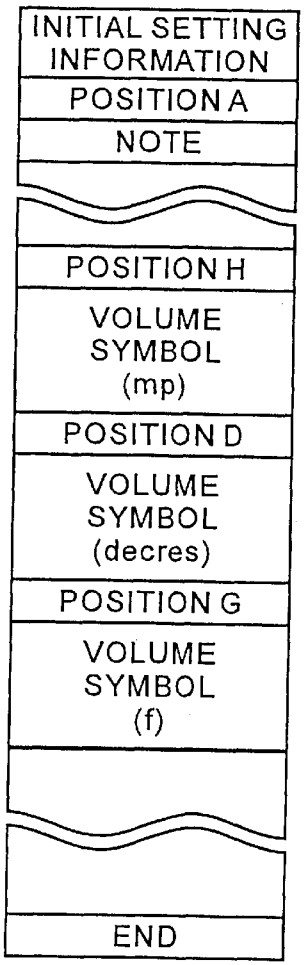

The operation of editing the data shown in FIG. 11A by the sectional editing process shown in FIG. 5 will be described with reference to FIGS. 11B and 11F.

First, volume symbols after the designated position are searched. Since forte (f) is stored at position G, the edition range is determined as a range down to the position immediately before position G. For the real performance data, a range down to the position immediately before timing F is determined as the edition range. During this volume symbol search, the volume symbol decrescendo (decres.) at position D before position G is not detected because it is not the global editing data. A judgment whether the volume symbol is the global editing data or not is executed, as described earlier, by using a table (prepared in advance) which stores a correspondence between each expression symbol and a local editing symbol or a global editing symbol.

Next, mezzo piano (mp) is inserted into the musical score data at position H, and EXP (40) is inserted into the real performance data at corresponding timing H. The musical score data is therefore changed as shown in FIG. 11F.

Next, a difference is calculated between the parameter value EXP (60) at timing C and the inserted parameter value EXP (40) immediately after the parameter EXP (60). In Example 3, the difference is "−20". Parameters (EXP) of the same kind in the edition range are detected. In Example 3, parameters (EXP) at timings D, E and F are detected.

The calculated difference "−20" is added to the detected parameters. With these operations, the parameter value at timing D is changed to EXP (38), the parameter value at timing E is changed to EXP (36), and the parameter value at timing F is changed to EXP (34), as shown in FIG. 11B.

Figure 12A:
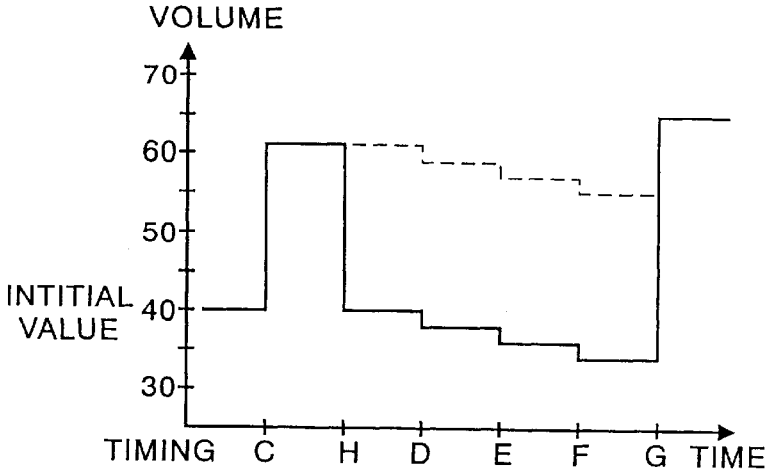
FIGS. 12A to 12C are timing charts illustrating volume changes.

FIG. 12A is a graph showing a change in the volume according to the data shown in FIGS. 11A and 11B. In FIG. 12A, a broken line represents the data before edition (FIG. 11A) and a solid line represents the data after edition (FIG. 11B).

The data before the edition indicated by the broken line has the intonation that the volume lowers gradually (decrescendo) and rises at timing G (forte). The data after the edition indicated by the solid line also retains the intonation although the volume lowers at timing H (mezzo piano) and thereafter lowers until timing G.

Next, the operation lo be executed when a user manually selects the local or global editing process will be described.

FIG. 11D is a diagram showing real performance data obtained by editing the data shown in FIG. 11A by the local editing process shown in FIG. 4. The operation to be executed for the musical score data is similar to that of the above-described sectional editing process.

Only EXP (40) is inserted into the real performance data at timing H between timings C and D. The other parameter values are not changed.

Figure 12B:
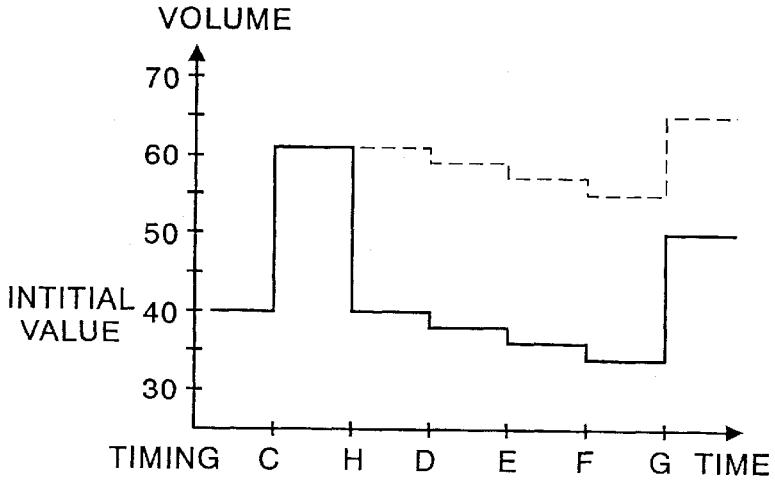
Figure 12C:
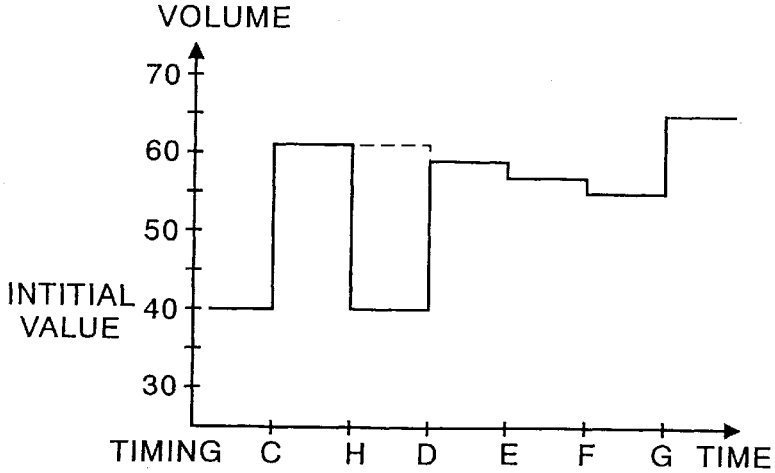
Figure 13:
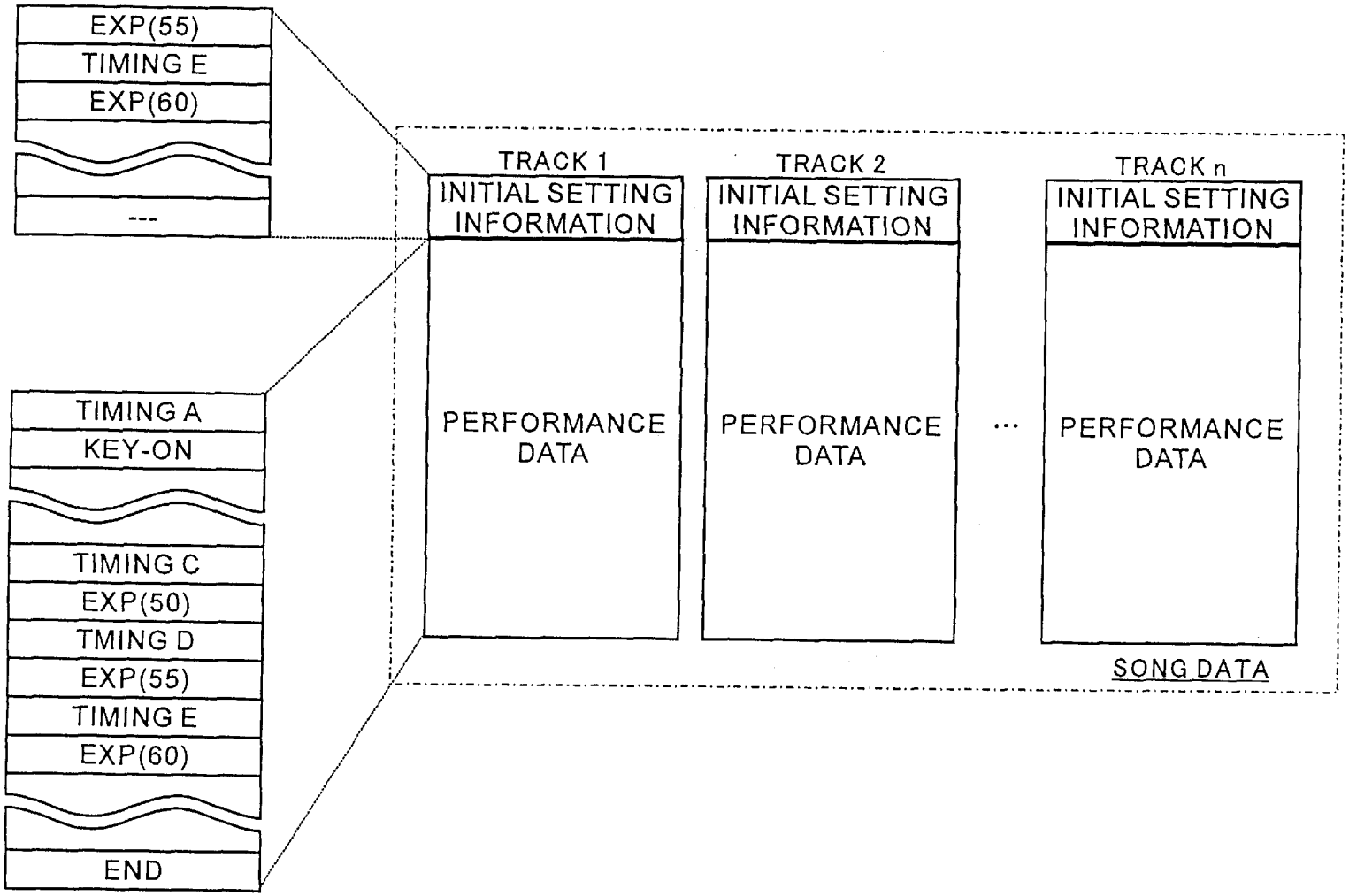
FIG. 13 is a diagram showing the format of real performance data.

FIG. 12C is a graph showing a change in the volume corresponding to the data shown in FIGS. 11A and 11D. In FIG. 12C, a broken line represents the data before edition (FIG. 11A) and a solid line represents the data after edition (FIG. 11D).

The data before the edition indicated by the broken line has the intonation that the volume lowers gradually (decrescendo) and rises at timing G (forte). The data after the edition loses the continuity of performance. Namely, after the volume lowers at timing H, the parameters after this timing do not change. Therefore, at timing D at which the decrescendo of gradually lowering the volume, the volume rises abruptly, giving a listener unnatural feeling.

FIG. 11C is a diagram showing real performance data obtained by editing the data shown in FIG. 11A by the global editing process shown in FIG. 6.

First, the whole range after the designated position is determined as the edition range, and mezzo piano (mp) is inserted into the musical score data at position H, and EXP (40) is inserted into the real performance data at corresponding timing H. The musical score data is therefore changed as shown in FIG. 11F.

Next, a difference is calculated between the parameter value EXP (60) at timing C and the inserted parameter value EXP (40) immediately after the parameter EXP (60). In Example 3, the difference is "−20". Parameters (EXP) of the same kind in the edition range are detected. In Example 3, parameters (EXP) at timings D, E, F and G are detected.

The calculated difference "−20" is added to the detected parameters. With these operations, the parameter value at timing D is changed to EXP (38), the parameter value at timing E is changed to EXP (36), the parameter value at timing F is changed to EXP (34), and the parameter value at timing G is changed to EXP (50), as shown in FIG. 11C.

FIG. 12B is a graph showing a change in the volume corresponding to the data shown in FIGS. 11A and 11C. In FIG. 12B, a broken line represents the data before edition (FIG. 11A) and a solid line represents the data after edition (FIG. 11C) The data before the edition indicated by the broken line has the intonation that the volume lowers gradually (decrescendo) and rises at timing G (forte). The data after the edition indicated by the solid line also retains the original intonation although the volume is small. However, since the global editing data is changed, the parameter value at timing G corresponding to the position of the real performance data is changed to EXP (50) regardless of forte (f) inserted into the musical score data at position G.

Figure 11G:
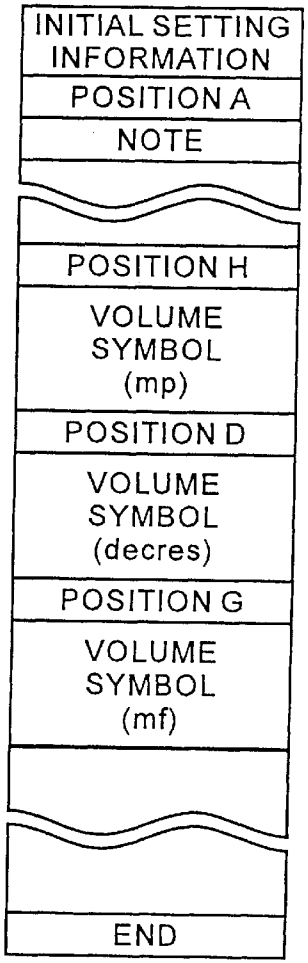

Namely, although the intonation can be retained perfectly, the musical score data and real performance data contradict each other. In order to solve this problem, the musical score data may be made to be automatically changed so that the volume symbol forte (f) at position G is changed to the mezzo forte (mf) corresponding to the changed parameter value EXP (50), as shown in FIG. 11G.

The invention may be embodied by installing a program realizing the embodiment function into a commercially available general computer, personal computer or the like.

In this case, the program realizing the embodiment function may be stored in a computer readable storage medium such as a CD-ROM and a floppy disk and supplied to users.

If the general computer, personal computer or the like is connected to a communication network such as a LAN, the Internet and a telephone line, the program and relevant data may be supplied to the general computer, personal computer or the like via the communication network.

The present invention has been described in connection with the preferred embodiments. The invention is not limited only to the above embodiments. It is apparent that various modifications, improvements, combinations, and the like can be made by those skilled in the art.

What is claimed is:

1. A musical performance data editing system, comprising:

storage means for storing a musical performance data to be edited;

edition designating means for designating an edition position and edition content in the musical performance data to be edited, the edition content corresponding to either one of a global editing data which changes the musical performance data within the edition range or a local editing data which changes the musical performance data only at the edition position;

detecting means for detecting a first global editing data from the musical performance data at positions after the edition position when the edition content corresponds to the global edition data;

edition range determining means for determining a range from the edition position to a position just before the first global editing data detected by said detecting means as an edition range when the edition content corresponds to the global edition data, and determining the edition position as an edition range when the edition content corresponds to the local editing data; and editing means for editing the musical performance data regarding the edition content in the determined edition range in accordance with the edition content.

2. A musical performance data editing system according to claim 1, wherein said edition range determining means determines a range from the edition position to an end of the musical performance data as said edition range when said detecting means detects no global editing data from the musical performance data at positions after the edition position in case that the edition content corresponds to the global edition data.

3. A musical performance data editing system according to claim 1, wherein said musical performance data is MIDI data.

4. A musical performance data editing system according to claim 3, wherein said edition content is an expression data for volume of sound produced by said MIDI data.

5. A musical performance data editing system according to claim 1, wherein said musical performance data includes MIDI data and musical score data corresponding to the MIDI data.

6. A musical performance data editing system according to claim 1, wherein said edition designating means further designates an edition range directly, and said edition range determining means determines the edition range designated by said edition designating means as said edition range.

7. A musical performance data editing system according to claim 1, wherein said detecting means further detects a parameter relevant to the edition content in the edition range, and said editing means edits the parameter detected by said detecting means in the edition range.

8. A musical performance data editing system according to claim 7, wherein said storage means further stores a table of a specific condition for determining which data is said global editing data.

9. A musical performance data editing system according to claim 8, wherein said specific condition is a specific value of a parameter.

10. A musical performance data editing system according to claim 7, wherein said editing means calculates a difference between values of a parameter at the edition position before the edition of said editing means and after the edition, and edits the parameter detected by said detecting means by adding the calculated difference to said parameter detected by said detecting means.

11. A musical performance data editing system according to claim 7, wherein said editing means calculates a ratio of a value of a parameter at the edition position after the edition of said editing means to the value before the edition, and edits the parameter detected by said detecting means by multiplying said parameter detected by said detecting means by the calculated ratio.

12. A musical performance data editing system according to claim 7, wherein said edition range determining means determines a range from the edition position to a position just before the first global editing data detected by said detecting means as said edition range, and when said detecting means does not detect said global editing data, said edition range determining means determines a range from the edition position to an end of the musical performance data as said edition range.

13. A musical performance data editing system according to claim 7, wherein said edition range determining means determines a range from the edition position to an end of the musical performance data as said edition range when said detecting means detects no global editing data from the musical performance data at positions after the edition position in case that the edition content corresponds to the global edition data.

14. A musical performance data editing system according to claim 7, wherein said global editing data is a parameter having a specific value and changing a specific musical characteristic, and said parameter relevant to the edition content is a parameter changing the same musical characteristic to be changed by said global editing data.

15. A musical performance data editing system according to claim 14, wherein said edition range determining means determines a range from the edition position to a position just before said first global editing data detected by said detecting means as said edition range when the edition content corresponds to the global edition data, and when the edition content corresponds to the local editing data, said edition range determining means determines the edition position as said edition range.

16. A musical performance data editing system according to claim 7, wherein said musical performance data is MIDI data.

17. A musical performance data editing system according to claim 16, wherein said edition content is an expression data for volume of sound produced by said MIDI data.

18. A musical performance data editing system according to claim 7, wherein said musical performance data includes MIDI data and musical score data corresponding to the MIDI data.

19. A musical performance data editing system according to claim 7, wherein said edition designating means further designates an edition range directly, and said edition range determining means determines the edition range designated by said edition designating means as said edition range.

20. A musical performance data editing apparatus, comprising:

an edition designating device which designates an edition position and edition content in musical performance data to be edited, the edition content corresponding to either one of a global editing data which changes the musical performance data within the edition range or a local editing data which changes the musical performance data only at the edition position;

a detector which detects a first global editing data from the musical performance data at positions after the edition position when the edition content corresponds to the global edition data;

an edition range determining device which determines a range from the edition position to a position just before the first global editing data detected by said detecting means as an edition range when the edition content corresponds to the global edition data, and determining the edition position as an edition range when the edition content corresponds to the local editing data; and an editor which edits the musical performance data regarding the edition content in the determined edition range in accordance with the edition content.

21. A musical performance data editing method, comprising the steps of:

(a) designating an edition position and edition content in musical performance data to be edited, the edition content corresponding to either one of a global editing data which changes the musical performance data within the edition range or a local editing data which changes the musical performance data only at the edition position;

(b) detecting a first global editing data from the musical performance data at positions after the edition position when the edition content corresponds to the global edition data;

(c) determining a range from the edition position to a position just before the first global editing data detected by said detecting means as an edition range when the edition content corresponds to the global edition data, and determining the edition position as an edition range when the edition content corresponds to the local editing data; and (d) editing the musical performance data regarding the edition content in the determined edition range in accordance with the edition content.

22. A storage medium storing a program, which a computer executes to realize a musical performance data editing process, comprising the instructions for:

(a) designating an edition position and edition content in musical performance data to be edited, the edition content corresponding to either one of a global editing data which changes the musical performance data within the edition range or a local editing data which changes the musical performance data only at the edition position;

(b) detecting a first global editing data from the musical performance data at positions after the edition position when the edition content corresponds to the global edition data;

(c) determining a range from the edition position to a position just before the first global editing data detected by said detecting means as an edition range when the edition content corresponds to the global edition data, and determining the edition position as an edition range when the edition content corresponds to the local editing data; and (d) editing the musical performance data regarding the edition content in the determined edition range in accordance with the edition content.

* * * * *